US006008772A

United States Patent [19]

Legay et al.

[11] Patent Number: 6,008,772

[45] Date of Patent: Dec. 28, 1999

[54] RESONANT ANTENNA FOR TRANSMITTING OR RECEIVING POLARIZED WAVES

[75] Inventors: Hervé Legay, Plaisance Du Touch; Thierry Rostan, Toulouse; Frédéric Croq, Tournefeuille, all of France

[73] Assignee: Alcatel, Paris, France

[21] Appl. No.: 09/028,815

[22] Filed: Feb. 24, 1998

[51] Int. Cl.[6] ..... H01Q 1/00

[52] U.S. Cl. ..... 343/787; 343/846; 343/700 MS; 343/769; 343/789

[58] Field of Search ..... 343/787, 769, 343/789, 848, 898, 700 MS, 846

[56] References Cited

U.S. PATENT DOCUMENTS

| | | | |
|---|---|---|---|
| 2,802,209 | 8/1957 | Scheideler | 343/795 |
| 3,742,510 | 6/1973 | Spanos | 343/730 |
| 4,042,935 | 8/1977 | Ajioka et al. | 343/795 |
| 4,143,377 | 3/1979 | Salvat et al. | 343/755 |
| 4,208,660 | 6/1980 | McOwen, Jr. | 343/769 |

FOREIGN PATENT DOCUMENTS

0227121A1 7/1987 European Pat. Off. .

*Primary Examiner*—Don Wong
*Assistant Examiner*—James Clinger
*Attorney, Agent, or Firm*—Sughrue, Mion, Zinn Macpeak & Seas, PLLC

[57] ABSTRACT

An antenna includes a radiating resonant member for transmitting polarized microwaves. A first diffracting system radiates waves at an angle greater than the transmission angle of the radiating member. A second diffracting system corrects the purity of polarization of the waves for some directions at least.

11 Claims, 5 Drawing Sheets

RESONANT ANTENNA FOR TRANSMITTING OR RECEIVING POLARIZED WAVES

BACKGROUND OF THE INVENTION

1. Field of the Invention

The invention concerns a microwave transmit or receive antenna. It is more particularly concerned with a flat resonant antenna, for example one implemented using microstrip technology.

2. Description of the Prior Art

Antennas of the above type are compact and lightweight. They are therefore used in vehicular applications, in particular in spacecraft and satellites.

There is often a need, in particular in space applications, for omnidirectional antennas, i.e. antennas that can send or receive within a large solid angle.

However, it has been found that the requirement for omnidirectionality is difficult to reconcile with the need to conserve the purity of the polarization of the electromagnetic waves transmitted or received.

In particular, when the wave to be transmitted (or received) must have circular polarization it is necessary to conserve an ellipticity close to 1 in all transmission (or reception) directions.

The purity of polarization is usually degraded most in the directions farthest from the antenna axis.

The invention aims to provide a resonant antenna of maximal angular coverage within which coverage the purity of polarization is preserved.

SUMMARY OF THE INVENTION

The invention consists in an antenna comprising a radiating resonant member for transmitting polarized microwaves, first diffracting means for radiating waves at an angle greater than the emission angle of said radiating element and second diffracting means for correcting the purity of polarization of said waves for some directions at least.

Each diffracting member has a dimension at most in the same order of magnitude as the wavelength to be transmitted (or received).

In one embodiment the first diffracting means, adapted to increase the aperture angle of the beam to be transmitted, include a conductive ring concentric with the axis of the antenna and surrounding the radiating member, the ring being advantageously in substantially the same plane as the radiating member, and the second diffracting means include a conductive skirt disposed near the ring on the side opposite the radiation direction, the inclination of the skirt relative to the ring determining the main direction in which correction of polarization is effected.

In one embodiment the inner rim of the skirt is attached to the inner rim of the ring, the skirt and the ring forming a one-piece component, for example. With reference to correction of polarization purity, it has been found that better results are obtained if the greatest diameter of the skirt is greater than the outside diameter of the ring.

The resonant radiating member is a solid conductive member ("patch"), square or circular in shape, for example, or a conductive ring, or a slot in a conductive member. In any event, for a given wavelength to be transmitted (or received) it is beneficial, for maximizing the omnidirectionality, to provide an annular antenna, these shapes minimizing the overall size. The ring is either conductive or in the form of a slot. Minimizing the overall size of the resonant member and therefore maximizing the omnidirectionality can also be achieved by depositing the resonant conductive member on a high permitivity dielectric. However, increasing the permitivity degrades the purity of polarization.

Other features and advantages of the invention will become apparent from the description of embodiments of the invention given with reference to the appended drawings.

DETAILED DESCRIPTION OF THE PREFERRED EMBODIMENTS

Figure 1:
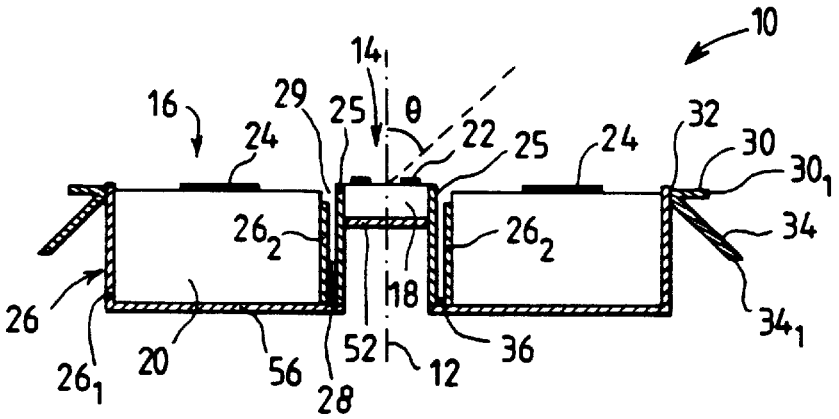
FIG. 1 is a schematic sectional view of an antenna in accordance with the invention that can be used for two bands of frequencies.

The antenna shown in FIG. 1 is designed to receive or to transmit microwave signals in two bands, namely the S band at 2 GHz and the UHF band at 400 MHz.

The antenna is primarily intended to be installed on small satellites such as satellites for tracking objects or for measurement or telecontrol missions on conventional satellites. Because of this application, it must have a small overall size, a wide angular coverage for both bands of frequencies and circular polarization with a suitable ellipticity over this wide angular coverage, in particular for orientations at the greatest distance from the axis.

The antenna 10 shown in FIG. 1 is of the combined type. It is formed by associating two concentric planar antennas 14 and 16. Each of the antennas 14 and 16 and the combination 10 has an axis 12 of rotational symmetry. The smaller central antenna 14 is for the S band at 2 GHz and the larger outer antenna 16 is for the UHF band at 400 MHz.

Each of the individual antennas 14, 16 includes a respective dielectric substrate 18, 20 on which is deposited a respective conductive ring 22, 24. The two rings 22 and 24 are centered on the axis 12.

Embodiments of the conductive rings 22 and 24 are described hereinafter with reference to FIGS. 2 and 3.

Each of the substrates is enclosed in a cylindrical metallic housing concentric with the axis 12, namely a housing 25 for the antenna 14 and a housing 26 for the antenna 16. The latter housing is delimited by a cylindrical outer wall $\mathbf{26}_1$ and by a cylindrical inner wall $26_2$ at a small distance from the wall of the housing 25.

The space 28 between the wall of the housing 25 and the wall $26_2$ has a length (in the direction of the axis 12) equal to one-quarter of the S band wavelength, i.e. approximately 35 mm. It is open at the end 29 from which transmission occurs. It constitutes a trap intended to prevent propagation of leakage currents from the ring 22 to the ring 24.

A metallic filler ring 36 can be placed at the bottom of the space 28 to adjust the length (parallel to the axis 12) of the space 28 so that it is equal to one-quarter the S band wavelength.

The walls 25 and $26_2$ can be formed from the same sheet of metal.

There is a metallic ring 30 around the housing 26, substantially in the plane of the ring 24 and therefore perpendicular to the axis 12.

The inner rim 32 of the ring 30 is connected to a skirt 34 diverging from the ring 30 towards the bottom of the housing 26 and from the axis 12. In one example the angle in the plane of FIG. 1 between the plane of the ring 30 and the skirt 34 is in the order of 45°.

The ring 22 radiates in a cone concentric with the axis 12 having a half-angle θ at the apex equal to approximately 60°. There is radiation external to this cone, however. The purpose of the ring 30 is to diffract the deflected waves outwards in order to increase the omnidirectionality of the antenna 14.

However, it has been found that the ring 30 tends to degrade the circular polarization of the radiation, in other words to degrade the ellipticity. Experience has shown that the skirt 34 preserves an ellipticity of circular polarization waves close to 1, especially for directions at a large angle to the axis 12.

The ellipticity can be adjusted empirically by varying the orientation of the skirt 34, i.e. the angle between it and the plane of the ring 30, and by varying its dimensions.

The outer edge $34_1$ of the skirt 34 is at a greater distance from the axis 12 than the outer edge $30_1$ of the ring 30.

In one example the inside diameter of the ring 30 is 256 mm, its outside diameter is 300 mm and the outside diameter of the skirt 34, which is generally frustoconical, is 348 mm.

It is thought that the skirt 34 causes diffraction of S band waves that opposes the negative effect of the diffracting ring 30 on the ellipticity of the S band waves.

Note that the housings or cavities 25 and 26 contribute to rendering the radiation diagram symmetrical about the axis 12 and to improving the ellipticity.

In the example the dielectric substrates 18 and 20 have a relative dielectric permitivity $\epsilon_r$ in the order of 2.5. As indicated above, the higher the dielectric permitivity the greater the potential reduction in the dimensions of the antennas. However, increasing the dielectric constant degrades the circular polarization. This is why in the example the constant $\epsilon_r$ does not exceed 2.5.

Figures 1A, 1B, 1C:
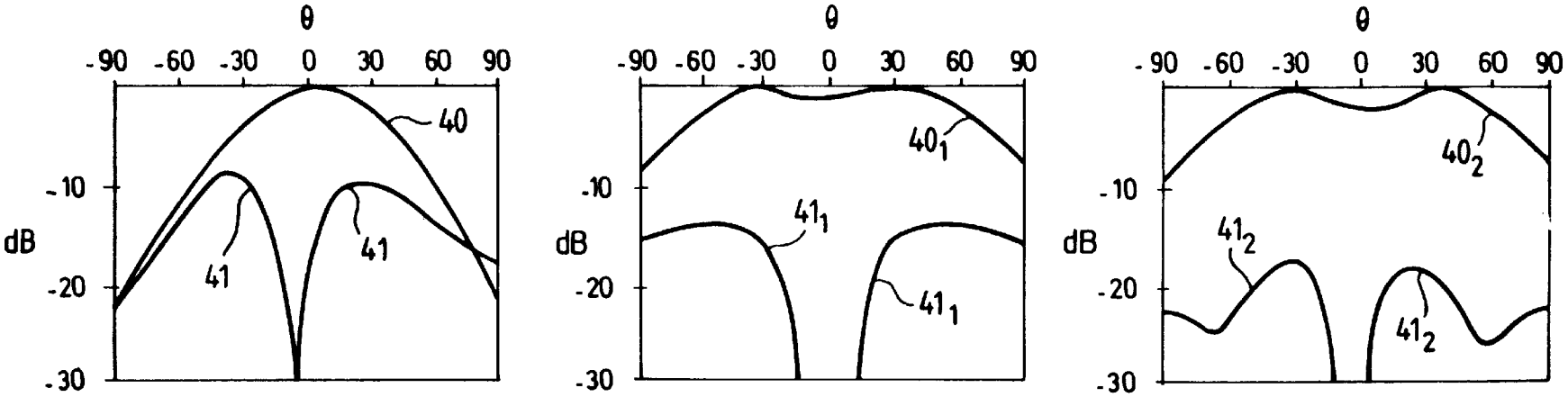
FIGS. 1*a,* 1*b* and 1*c* are diagrams showing the advantages of the antenna from FIG. 1.

FIGS. 1*a*, 1*b* and 1*c* are diagrams showing the advantages of the quarter-wave trap constituted by the annular space 28 and the diffracting members 30 and 34.

In each diagram the elevation θ (in degrees), i.e. the half-angle of the emission cone concentric with the axis 12, is plotted on the abscissa axis and the amplitude (in decibels) of the radiation with normal polarization and with crossed polarization is plotted on the ordinate axis.

FIG. 1*a* is a diagram for an antenna similar to that from FIG. 1 but without the quarter-wave trap 28 and without the diffracting members 30 and 34.

The curve 40 corresponds to normal polarization and the curves 41 correspond to crossed polarization. The purity of circular polarization is directly proportional to the difference between the curves 40 and 41. Accordingly, for an angle θ of 0°, i.e. along the axis 12, emission is with circular polarization. However, on moving away from the axis 12, the circular polarization is significantly degraded.

Furthermore, emission is significantly attenuated immediately on moving away from the axis 12.

FIG. 1*b* corresponds to an antenna similar to that from FIG. 1 with a quarter-wave trap 28 but with no diffracting members 30 and 34.

The omnidirectionality and the purity of circular polarization are improved compared to FIG. 1*a*. However, the purity of circular polarization is not entirely satisfactory between 30° and 60°, the distance between the curves $41_1$ and $40_1$ remaining relatively small.

The diagram in FIG. 1*c* corresponds to the antenna shown in FIG. 1 with a quarter-wavelength trap 28, the ring 30 and the skirt 34. Compared to FIG. 1*b*, the omnidirectionality is entirely satisfactory up to an angle θ of 60°. Further, the purity of circular polarization is significantly improved between the angles of 30° and 60°, the distance between the curves $40_2$ and $41_2$ being significantly greater.

In accordance with one feature of the invention the antenna is made more compact by imparting a crenellated or meandering shape to the rings 22 and 24.

Figure 2:
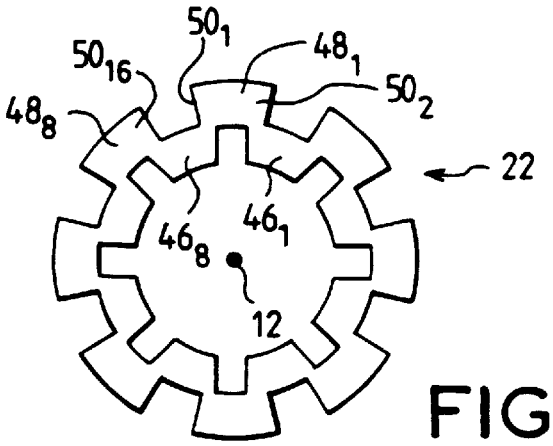
FIG. 2 is a schematic plan view of a ring of an antenna in accordance with the invention.

In the FIG. 2 example the ring 22 has eight inside segments $46_1$ through $46_8$ equi-angularly distributed around the axis 12 and alternating with eight outer segments $48_1$ through $48_8$. These circular arc shape segments 46 and 48 are joined at their ends by radial rectilinear segments 50. Accordingly there are 16 radial segments in this example. Although this is not shown in FIG. 2, the ring 24 is geometrically similar to the ring 22.

Figure 3:
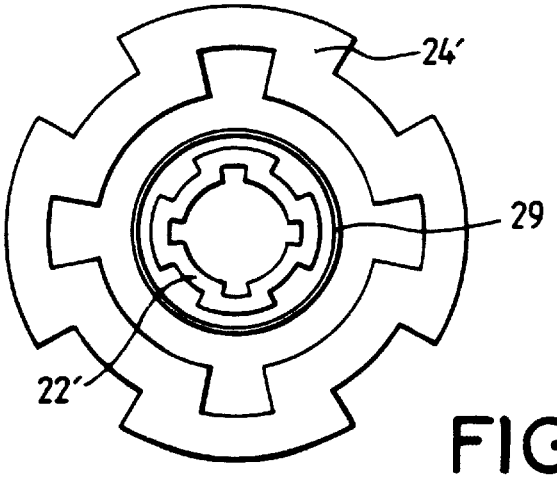
FIG. 3 is a schematic plan view of two rings of an antenna constituting a different embodiment of the invention.

In the FIG. 3 example the S band antenna 22' and the UHF band antenna 24' each have four inner segments and four outer segments.

The guided wavelength of the radiation to be transmitted is directly proportional to the electrical length of the ring of the resonant antenna 14 (14') or 16 (16'). This electrical length is equal to the sum of the lengths of all the segments 46, 48 and 50.

Accordingly, for the same guided wavelength, i.e. for the same frequency, an antenna in accordance with the invention has a smaller overall size than an antenna of merely circular shape. Compared to a circular ring having the same diameter as the circle on which the segments 48 are disposed, the electrical length is increased by approximately the sum of the lengths of the segments 50.

However, it has been found that increasing the length of the segments 50 reduces the efficiency of the antenna. The radiation impedance of the antenna is reduced because the metallic strip masks more of the aperture; accordingly the proportion of energy dissipated in the conductor or the dielectric is greater. It is therefore preferable for the outside diameter to be not more than approximately twice the inside diameter.

It has been found that the presence of the radial segments 50 does not significantly degrade the ellipticity of the polarization of the radiation. A radial segment also has the drawback of interfering with the ellipticity. Nevertheless, it is thought that it is the succession of segments in which currents flow in opposite directions that compensates the negative effect on the ellipticity.

Care must therefore be exercised to dispose the segments so that such compensation is obtained.

Figure 4:
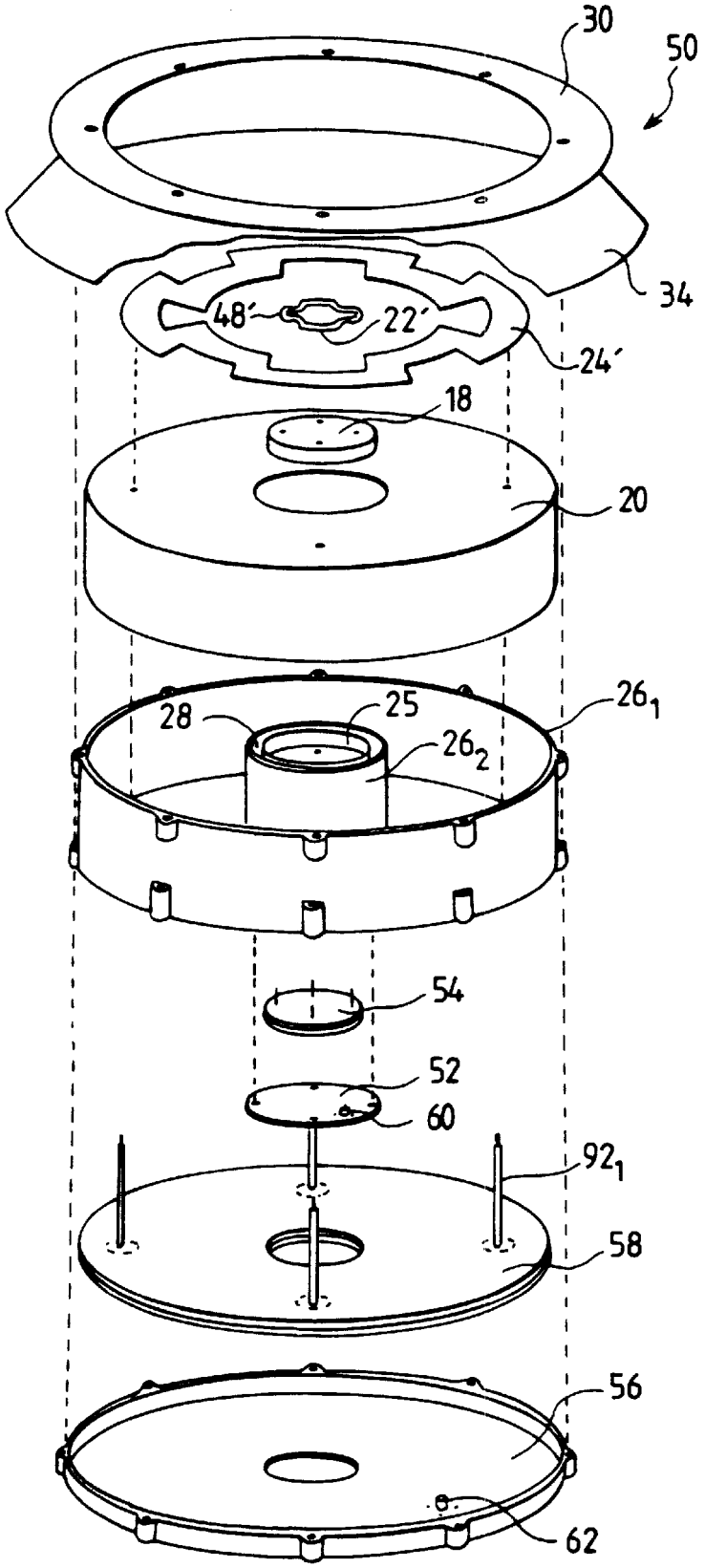
FIG. 4 is a schematic exploded perspective view of an antenna of the same type as that from FIG. 1.

FIG. 4 is an exploded perspective view of the various component parts of the combined antenna with rings 22' and 24' of the FIG. 3 type.

This figure shows that the ring 30 and the skirt 34 inclined at 45° constitute a one-piece component 50.

The rings 24' and 22' are etched onto respective dielectric substrates 18 and 20 of a material known as "polypenco". FIG. 4 shows the rings 22' and 24' separate from the substrates 18 and 20 but it goes without saying that the rings are deposited on the respective substrates 18 and 20.

Figure 5:
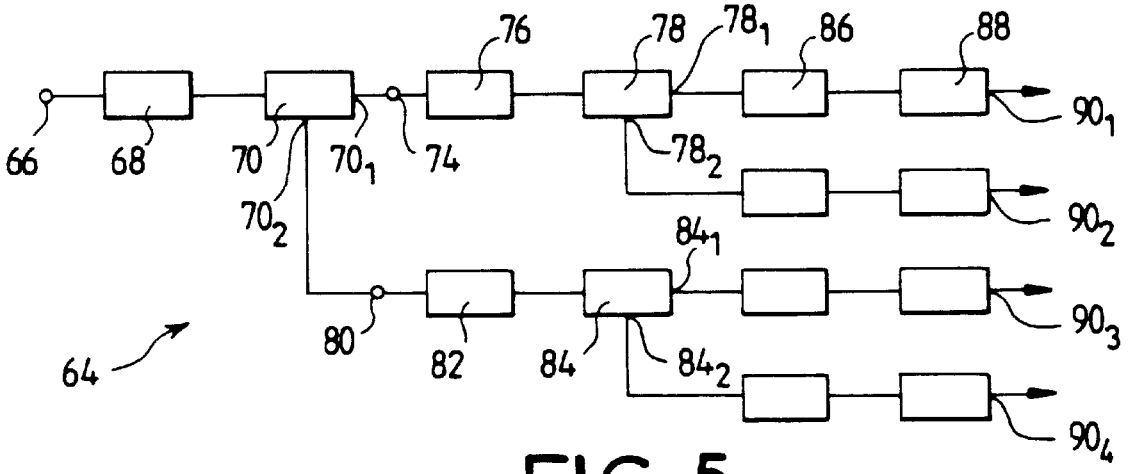
FIG. 5 is a block diagram of the excitation circuit of a ring of the antenna from FIG. 4.
Figure 6:
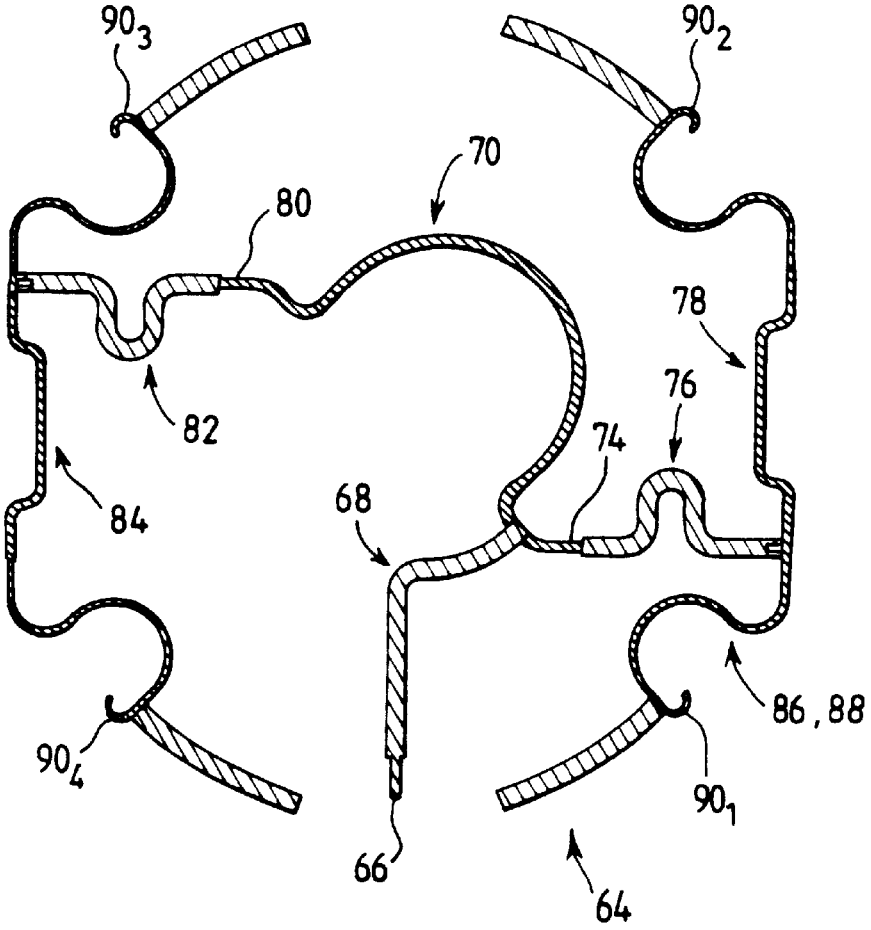
FIG. 6 is a schematic corresponding to one embodiment of FIG. 5.
Figure 7:
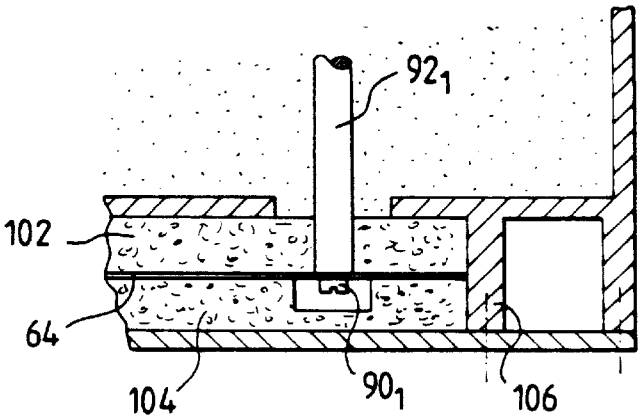
FIG. 7 is a schematic also corresponding to one embodiment of FIG. 5.

A distributor 54 described below with reference to FIGS. 5 through 7 is disposed between the bottom 52 of the housing 25 and the substrate 18.

A coaxial cable 60 passes through the bottom 52 of the housing 25 to feed the excitation signal to the distributor 54. The function of the latter is to distribute the excitation signal with the appropriate phase-shifts between the four outer segments 48' of the ring 14'.

A distributor 58 is similarly disposed between the bottom 56 of the housing 26 and the dielectric 20.

A coaxial cable 62 passes through the bottom 56 to feed the UHF excitation signal to the distributor 58 which distributes this excitation signal with the appropriate phase-shifts between the four outer segments of the ring 24'.

FIGS. 5, 6 and 7 show the distributor 54.

The circuits 64 shown in FIGS. 5 and 6 produce circular polarization from the excitation signal supplied via the coaxial cable 60. To this end they feed the four outer segments 48' with successive phase-shifts of 90°.

The signal from the coaxial cable 60 is fed to an input 66 which, as shown in FIG. 5, is connected to the input of a 180° phase-shifter 70 via a transformer 68. The output $\mathbf{70}_1$ with zero phase-shift of the phase-shifter 70 is connected to a port 74 which is in turn connected to a 90° phase-shifter 78 via a transformer 76. The output $\mathbf{70}_2$ with a phase-shift of 180° of the phase-shifter 70 is connected to another port 80 which is connected to a second 90° phase-shifter 84 via a transformer 82.

The output $\mathbf{78}_1$ with zero phase-shift of the phase-shifter 78 is connected to a first output $\mathbf{90}_1$ of the circuit 64 via a transformer 86 and an adapter 88. The output $\mathbf{90}_1$ is connected to a first outer segment of the ring 22'.

Similarly, the output $\mathbf{78}_2$ with a phase-shift of 90° of the phase-shifter 78 is connected to a second output $\mathbf{90}_2$ via another transformer and another adapter. The output $\mathbf{90}_2$ is connected to a second outer segment of the ring 22'.

The output $\mathbf{84}_1$ with zero phase-shift of the phase-shifter 84 is connected to the third output $\mathbf{90}_3$ via a transformer and an adapter. The output $\mathbf{90}_3$ is connected to a third outer segment of the ring 22'.

Finally, the output $\mathbf{84}_2$ with a phase-shift of 90° of the phase-shifter 84 is connected to the fourth output $\mathbf{90}_4$ of the circuit 64 via a transformer and an adapter. The output $\mathbf{90}_4$ is connected to a fourth outer segment of the ring 22'.

The signal at the output $\mathbf{90}_1$ is in phase with the input signal at the first port 66. The signals at the outputs $\mathbf{90}_2$, $\mathbf{90}_3$ and $\mathbf{90}_4$ are respectively phase-shifted 90°, 180° and 270° relative to the input signal.

The various elements of the circuit from FIG. 5 are obtained by the metallic cut-outs shown in FIG. 6. This figure shows the same components as FIG. 5 using the same reference numbers.

The outputs $\mathbf{90}_1$ through $\mathbf{90}_4$ are at the periphery of the cut-outs and equi-angularly distributed; these outputs are in line with the outer segments of the ring 22' to which they are connected.

FIG. 7 shows that the metallic cut-outs are sandwiched between respective dielectric distributors 102 and 104.

Each output 90 of the circuit 64 is connected to the corresponding outer segment of the ring by a probe 92. Four probes are therefore provided. FIG. 7 shows the probe $\mathbf{92}_1$.

The distributor 64, 102, 104 is enclosed in a metallic housing 106 constituting a trap preventing excitation of surface waves on the distributor.

Alternatively, in place of strips or metallic cut-outs, the circuit 64 is obtained by etching a substrate.

Figure 8:
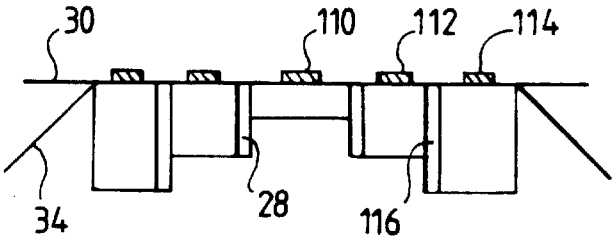
FIG. 8 is a simplified schematic corresponding to that of FIG. 1 for a different embodiment.

In the example shown in FIG. 8, three concentric antennas are provided, respectively a central antenna 110, an intermediate antenna 112 and an outermost antenna 114.

As in the embodiment shown in FIG. 1, a diffraction ring 30 surrounds the outermost antenna and the ring 30 is attached to a skirt 34 at substantially 45° to the plane of the ring 30. Also as in the FIG. 1 embodiment, a quarter-wave trap 28 prevents any leakage current propagating from the excited cavity to the surrounding cavities. Similarly, a quarter-wave trap 116 prevents propagation of any leakage current towards the antenna 114.

The length (along the axis) of the trap 116 is greater than that of the trap 28 because it is designed to eliminate longer wavelengths, those of the signals emitted by the antenna 112.

Of course, a number of concentric antennas greater than three can be provided.

Although the examples described hereinabove concern resonant ring antennas formed by a metallic conductor, the invention obviously applies equally to an antenna formed by a slot in a conductor. In some applications, in particular those for which heating must be minimized, this slotted implementation is preferable.

Figure 9:
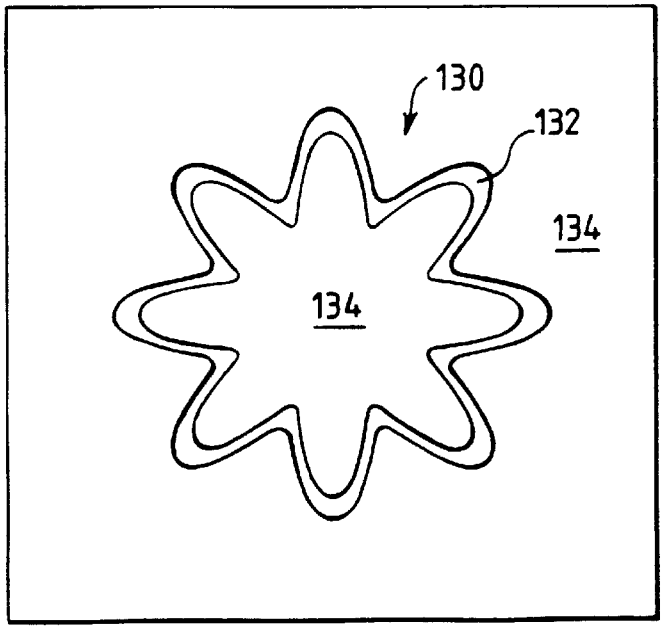
FIG. 9 is a schematic plan view of a ring for a different embodiment.

The variant shown in FIG. 9 has an annular resonant cavity that is more particularly applicable to a slotted antenna. Nevertheless, this example could also apply to a resonant ring antenna formed by a metallic conductor.

The ring 130 is constituted by a slot 132 in a metallic conductor 134. The ring 130 forms meanders each of which is substantially petal-shape. In this embodiment the number of petals is equal to eight.

Although in the examples described hereinabove the excitation is applied to the outer segments by means of a coaxial cable, excitation can equally be obtained by proximity coupling with a microstrip line or with a slot in the ground plane, i.e. in a cavity bottom.

There is claimed:

1. An antenna comprising a radiating resonant member for transmitting polarized microwaves, first diffracting means for radiating waves at an angle greater than the emission angle of said radiating member and second diffracting means for correcting the purity of polarization of said waves for at least some direction at least wherein said first diffracting means include a ring surrounding said radiating member and said second diffracting means include a skirt, having an inner rim attached to an inner rim of said ring, extending backwardly from said radiating member.

2. The antenna claimed in claim 1 wherein said second diffracting means increase the purity of polarization in angular directions greater than the emission angle of said antenna.

3. The antenna claimed in claim 1 wherein an angle between said skirt and said ring is approximately 45°.

4. The antenna claimed in claim 1 wherein said skirt is substantially frustoconical in shape and has an outer edge of greater diameter than an outer edge of said ring.

5. The antenna claimed in claim 1 wherein the inclination of said skirt relative to said axis of said antenna determines the main direction of polarization correction.

6. The antenna claimed in claim 1 wherein the dimensions of said skirt determine the main direction of polarization correction.

7. The antenna claimed in claim 1 wherein said ring is in substantially the same plane as said radiating member.

8. An antenna as claimed in claim 1 including at least one other antenna between said radiating member and said first and second diffracting means.

9. The antenna claimed in claim 1 wherein said radiating member is disposed on a dielectric substrate enclosed in a conductive housing having walls substantially parallel to an axis perpendicular to the surface of said radiating member.

10. An antenna as claimed in claim 1 adapted to transmit S band waves.

11. An antenna as claimed in claim 1 adapted to transmit circular polarization waves.

* * * * *